United States Patent [19]

McGee

[11] 4,254,582

[45] Mar. 10, 1981

[54] ELECTRICALLY ACTUATED OVERHEAD GARAGE DOOR OPENER ASSEMBLY

[76] Inventor: Michael H. McGee, 2334 Clement Ave., Venice, Calif. 90291

[21] Appl. No.: 60,636

[22] Filed: Jul. 25, 1979

[51] Int. Cl.[3] ..... E05F 11/00; E05F 15/00

[52] U.S. Cl. ..... 49/199; 49/280; 292/DIG. 36; 292/33; 292/144

[58] Field of Search ..... 49/199, 280, 449, 394, 49/395, 25; 70/282, 283; 292/DIG. 36, 144, 33

[56] References Cited

U.S. PATENT DOCUMENTS

| | | | |
|---|---|---|---|
| 1,367,931 | 2/1921 | Varnum | 49/280 X |
| 1,654,207 | 12/1927 | Bergonzoni | 70/282 |
| 2,530,629 | 11/1950 | Pringle | 49/199 X |
| 2,562,825 | 7/1951 | Schlytern . | |
| 2,607,586 | 8/1952 | Schlytern | 49/280 X |
| 2,672,943 | 3/1954 | Chatlynne el al. | 292/144 X |
| 3,096,815 | 7/1963 | May | 49/280 X |
| 3,731,963 | 5/1973 | Pond | 292/144 |
| 3,792,888 | 2/1974 | Kambic | 292/144 X |
| 3,996,591 | 12/1976 | Hayward | 49/25 |

*Primary Examiner*—Philip C. Kannan

*Attorney, Agent, or Firm*—Mahoney & Schick

[57] ABSTRACT

A conventional garage door opener assembly has integrated therewith an electrically actuated solenoid assembly at each side of the garage door actionable between the garage door frame and the door. In the case of a solidly assembled door pivotal between closed and opened position, the solenoid assemblies are mounted near the lower extremities of the door so as not to interfere with door movement, while still being capable of locking the door in closed position. The solenoid assemblies are interiorly secured at the door frame sides with the housings thereof permanently projecting across the clearance spaces between the door frame and door and interiorly overlapping the door with the solenoid plungers projectable therefrom in this overlapping positioning into aligned latch members secured interiorly of the door. The electrical power supplies for the solenoid assemblies are preferably directly connected into the controlling power supply circuits of the conventional garage door opener so that actuation of the opener causes coordinated simultaneous actuation of the solenoid assemblies to properly release the door for opening movement and lock the door in closed position. The individual solenoid assemblies may include unique guide rod actuation and guiding of the solenoid plungers, and unique plunger movement control and limitation by a simplified stop plate.

22 Claims, 5 Drawing Figures

ELECTRICALLY ACTUATED OVERHEAD GARAGE DOOR OPENER ASSEMBLY

BACKGROUND OF THE INVENTION

This invention relates to an electrically actuated overhead garage door opener assembly and more particularly, to improvements therein which provide greatly increased security for the garage door in its closed position. Furthermore, the improvements of the present invention include the use of a unique electrically actuated solenoid construction which is greatly simplified over the prior constructions while providing a more positive and dependable operational function so as to be capable of manufacturing and use at a reduced overall cost.

Electrically actuated overhead garage door opener assemblies have been in use for a relatively long period of time functional for automatically opening and closing garage doors through control by either an interior control switch or remote control means normally carried in the automobile making use of the garage. Furthermore, it is a well known fact and quite disturbing to the average citizen that crime has been increasing rapidly over the past decade, particularly including unauthorized residential entry with resulting burglary and sometimes even more serious personal crimes. As related to the present subject matter, many of these attempts at unauthorized entry and particularly the unauthorized entry of residences have been directed at unauthorized entry of residences through overhead garage doors and in many cases where the entry into the garage provides directly connected and ready entry into the residential living quarters. Unfortunately, an alarming number of these unauthorized entry attempts have been successful.

Considering a specific example, these automatic garage door openers are commonly installed for opening and closing garage doors of the solid or single-piece assembly type wherein the garage door is pivotally mounted movable from closed position pivotally upwardly and rearwardly to an overhead, nearly horizontal position. With this type of garage door installation, two basic forms of automatic garage door opener assemblies are used, one of the friction engagement form and one of the rack and pinion form. With the friction engagement form, the electrically actuated garage door opener having an upper extremity of the door connected thereto travels rearwardly and forwardly along a nearly horizontal guide track with resilient rollers of the opener frictionally engaged with the guide track to supply the relative motion therebetween. In the rack and pinion form, the relative motion is supplied by a rotatable pinion of the opener moving along a rack of the guide track.

Considering the friction engagement form of automatic garage door opener installed with the pivotal solid assembly garage door, despite the fact that the relatively strong frictional engagement of the door opener maintains the garage door in a moderately secure closed position when in the non-actuated condition, it is still possible, if sufficient forces are applied near the lower edges of the door, to force the door toward open position. In other words, sufficient force is applied toward pivotally moving the door from closed toward opened position that the normal frictional bond between the opener and guide track is overcome a sufficient distance along the guide track to create an access opening beneath the door lower edge. Where the opener is of the rack and pinion form, frequently similar sufficient forces on the door will cause the pinion of the opener to "back" along the rack of the guide track resulting in a similar access opening. Even where the rack and pinion form is constructed to completely prevent any non-actuated relative movement between the pinion and rack, it still has been found possible to apply a sufficient force to a lower corner of the garage door which causes the same to flex or break and result in an unauthorized access opening.

OBJECTS AND SUMMARY OF THE INVENTION

It is, therefore, an object of this invention to provide an electrically actuated overhead garage door opener assembly which has improvements integrated therewith substantially frustrating the prior unauthorized entry attempts. With the improvements of the present invention, the garage door in its closed position is provided with positive locking means which not only positively prevents a person attempting unauthorized entry from forcing reverse movement of the opener along its guide track while the opener remains in non-actuated condition, but also can be installed to positively prevent any possible flexing of the lower corners of the garage door which could result in unauthorized access openings. Furthermore, this improved positive locking means may be electrically connected for direct simultaneous electrical control with the conventional door opener so that the two are perfectly coordinated to provide convenient and simple conventional garage door opening and closing.

In a preferred embodiment of the improvements of the present invention, the supplementary locking means for the garage door comprise electrically actuated solenoids, one at either door side edge and near the door lower edge. In each case, a solenoid is secured interiorly of the garage door frame extending across the clearance opening between the door and frame and markedly overlapping the side edge of the door, although not connected thereto. A latch member for each solenoid is interiorly secured to the door thereby receiving a solenoid plunger when the door is in closed position and the solenoid is not electrically actuated. The electric power supply line for each solenoid is preferably connected directly into the conventional controls for the garage door opener so that when the opener is electrically actuated, it causes simultaneous actuation of the solenoids to withdraw their plungers from the latch members and release the door for movement from or movement back into its closed position. The securement of the solenoids to the door frame extending across the clearance openings between the door and frame and overlapping the door places the solenoid plungers displaced from the clearance opening thereby frustrating unauthorized manual manipulation of these solenoid plungers through the clearance opening which could result in disengagement of the plungers from their latch members.

It is a further object of this invention to provide a preferred form of improved electrically actuated solenoid which is move positively actionable than the prior forms of solenoids while still being of greater simplicity and capable of more economical manufacture. One improvement in the solenoid construction may be a central, preferably floating guide rod for the solenoid plunger which forwardly compresses resilient means, such as a spring, within the plunger, this guide rod thereby serving the dual purpose of actuating the resilient means for reciprocal plunger movement within the solenoid coil and positively guiding the plunger during its reciprocal movement without the danger of any binding action therebetween. The solenoid construction is also operably provided with a simple stop plate which may be slidably inserted into assembly and engages a shoulder of the solenoid plunger to thereby limit the forward projecting movement of the solenoid plunger in a very simple and efficient manner.

Other objects and advantages of the invention will be apparent from the following specification and the accompanying drawings which are for the purpose of illustration only.

DESCRIPTION OF THE BEST EMBODIMENT CONTEMPLATED

Figure 1:
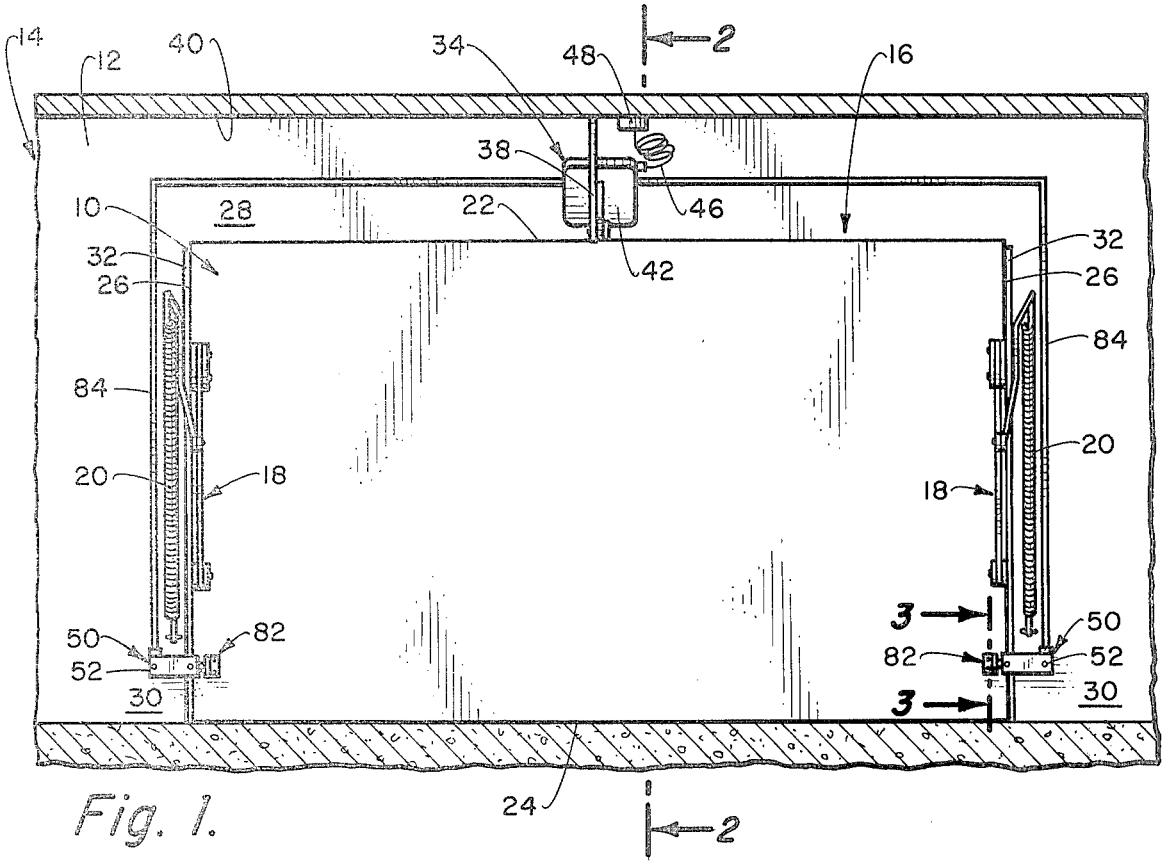
FIG. 1 is an inner side elevational view of a typical garage door having a preferred embodiment of the electrically actuated overhead garage door opener assembly of the present invention installed therewith, the garage door being shown in closed position and the garage being shown in fragmentary vertical section.

As hereinbefore broadly discussed, the improvements of the present invention relate to an electrically actuated overhead garage door opener assembly and more specifically to electrically actuated solenoid means integrated with the overhead garage door opener assembly for providing more secure retainment and locking of the overhead garage door in its closed position. Furthermore, as will be hereinafter specifically described, the improvements of the present invention are illustrated herein integrated with a particular common form of overhead garage door opener installed for opening and closing a particular common form of garage door, in this case, the garage door being a solid or single-piece assembly sometimes referred to as a "California door." It should be understood, however, that the principles of the present invention are equally applicable to virtually any form of overhead garage door and any form of electrically actuated overhead garage door opener assembly. Thus, it is not intended to limit the principles of the present invention to the specific embodiment shown and such principles should be broadly construed within the specifc limitations of the appended claims.

Referring to the drawings, an overhead garage door of the solid assembly type and movable as one piece is generally indicated at 10 mounted for closing and opening the usual opening at a front wall 12 of a garage generally indicated at 14, the garage opening being defined by the door frame generally indicated at 16. The garage door 10 is conventionally mounted in the door frame 16 pivotally movable by usual opposite side lever arrangements generally indicated at 18 including counter-balancing springs 20 secured to the interior surfaces of the door and frame. Thus, the garage door 10 is movable from a generally vertical closed position as shown in the drawings wherein it is closing off the opening formed by the door frame 16 pivotally upwardly and rearwardly interiorly of the garage 14 to an overhead, nearly horizontal open position (not shown) permitting free passage through the door frame into the garage.

More specifically, the garage door 10 includes the upper edge 22, the lower edge 24 and the opposite side edges 26 with the door frame 16 including the corresponding upper edge 28 and opposite side edges 30. It should be noted for purposes of later discussion that when the garage door 10 is in its closed position shown, clearance openings 32 are required between the garage door side edges 26 and the door frame side edges 30 in order to permit the door to move between its closed and opened positions and be properly received within the door frame when in its closed position. Of course, with a solid assembly of garage door 10, these clearance openings 32 are even more apparently required due to the pivotal movement between closed and opened positions of the door.

Completing the conventional aspects, a selectively electrically actuated garage door opener assembly is generally indicated at 34 and includes a nearly horizontally extending guide track 36 forwardly secured centrally above the door frame upper edge 28 to the garage front wall 12 and rearwardly secured by a support 38 to garage ceiling 40. The opener assembly 34 further includes a selectively electrically actuated opener 42 telescoping and movable generally rearwardly and forwardly along the guide track 36 carrying therewith an intermediately pivoted connecting arm 44 forwardly secured interiorly adjacent the upper edge 22 of the garage door 10. Various conventional types of garage door openers are available, two of the most common being rack and pinion type and friction type, with the assembly 34 illustrated herein being of the latter friction type wherein a reversible, electrically actuated motor within the opener 42 drives resilient friction rollers movably engaged with the guide track 36 to move the opener rearwardly along and forwardly along the guide track. The electrical circuit of the opener 42 is connected through an electric power supply line 46 to a control box 48 which, in turn, is operably connected into the electric power line of the garage 14 so that the opener may be reversely actuated by the usual interior control button (not shown) directly connected to the control box or a remote control button carried in an automobile, all in usual manner.

Thus, as with any usual garage door opener assembly, with the garage door 10 in closed position as shown, the opener 42 may be selectively actuated and will move rearwardly along the guide track 36 carrying the garage door upwardly and rearwardly in pivotal motion to the overhead open position where the opener automatically stops. A following electrical actuation will then reversely move the opener 42 along the guide track 36 pivotally moving the garage door 10 forwardly and downwardly back to fully closed position with the opener again automatically stopping.

Now, in view of the prevalency of crime and particularly burglaries in more recent modern times, one of the principal difficulties encountered with garage doors conventionally controlled by electrically actuated garage door openers has been surreptitious attempts to open such garage doors from their closed position without electrical actuation thereof, many such attempts proving to be successful. With a friction type opener, if sufficient opening forces are applied to the lower edge portion of the particular garage door, sometimes the friction bond between the opener and its guide track can be broken resulting in the garage door being opened sufficiently that unauthorized persons can enter the garage. With rack and pinion type openers, the same result can prevail if a sufficient force will cause movement of the pinion along the rack, but even where this is not possible, many times the lower corners of the door adjacent the edges thereof can be flexed or broken sufficiently to provide access for the unauthorized person.

According to the principles of the present invention, therefore, in order to more securely retain the garage door 10 in its closed position, electrically actuated solenoid assemblies generally between at least one and preferably both the garage door side edges 26 and the adjacent door frame side edges 30 near the garage door lower edge 24. Each solenoid assembly 50 is substantially the same and includes a preferably steel, box-like housing 52 enclosing a tubular solenoid coil 54 which is encased in steel and provides the solenoid with a rear wall 56, a plunger opening 58 of the coil opening oppositely and preferably being lined with a brass or other non-magnetic tube 60. The solenoid coil 54 is secured in the housing 52 by preferably four fasteners 62 with the solenoid plunger opening 58 aligned with a plunger clearance opening 64 of the housing 52.

A solenoid plunger 66 is axially movably received in the plunger opening 58 of the solenoid coil 54 normally telescoped by the solenoid coil and the plunger has an axial opening or recess 68 formed therein from the intermediate the plunger axial length rearwardly and opening rearwardly toward the coil rear wall 56. Resilient compression means preferably in the form of a compression spring 70 is forwardly received in the plunger recess 68 and is rearwardly abutted by a preferably brass or other non-magnetic guide member or rod 72 which, in turn, only rearwardly abuts the coil rear wall 56 so as to be free floating relative thereto while still being confined against rearward movement not only relative to such rear wall, but also the solenoid coil generally. Thus, the spring 70 will resiliently urge the plunger 66 forwardly to project forwardly from the plunger opening 58 of the solenoid coil 54 while the guide rod 72 will compress the spring and aid in guiding the plunger during such axial movement, the fact that the guide rod is floating as described permitting the same to continuously slightly adjust to thereby prevent any binding between the plunger and guide rod during this relative movement.

The rearward movement of the plunger 66 within the solenoid coil 54 upon electrical actuation of the solenoid coil is, of course, limited by the coil rear wall 56, such plunger rearward movement being permitted by compression of the spring 70. The forward movement of the plunger 66 during nonactuation of the solenoid coil 54, however, is limited by a transverse, preferably steel, stop plate 74 positioned forwardly between the solenoid coil 54 and the housing 52 engaging a transverse, forwardly exposed shoulder 76 of the plunger. The plunger shoulder 76 is preferably formed by a transversely stepped cut-out 78 of the plunger 66 extending from the plunger forward end continuously axially rearwardly to the intermediate location of the shoulder 76. Furthermore, the stop plate 74, although slidably received between the solenoid coil 54 and the housing 52 normally retained positioned by abutment, is preferably adhesively retained so positioned by an appropriate adhesive. Thus, this simple stop plate 74 very efficiently performs its important function of limiting the forward movement of the solenoid plunger 66 as urged by the plunger spring 70, yet may be quickly and efficiently assembled into its functional position during the assembly of the various solenoid parts within the housing 52.

Figure 2:
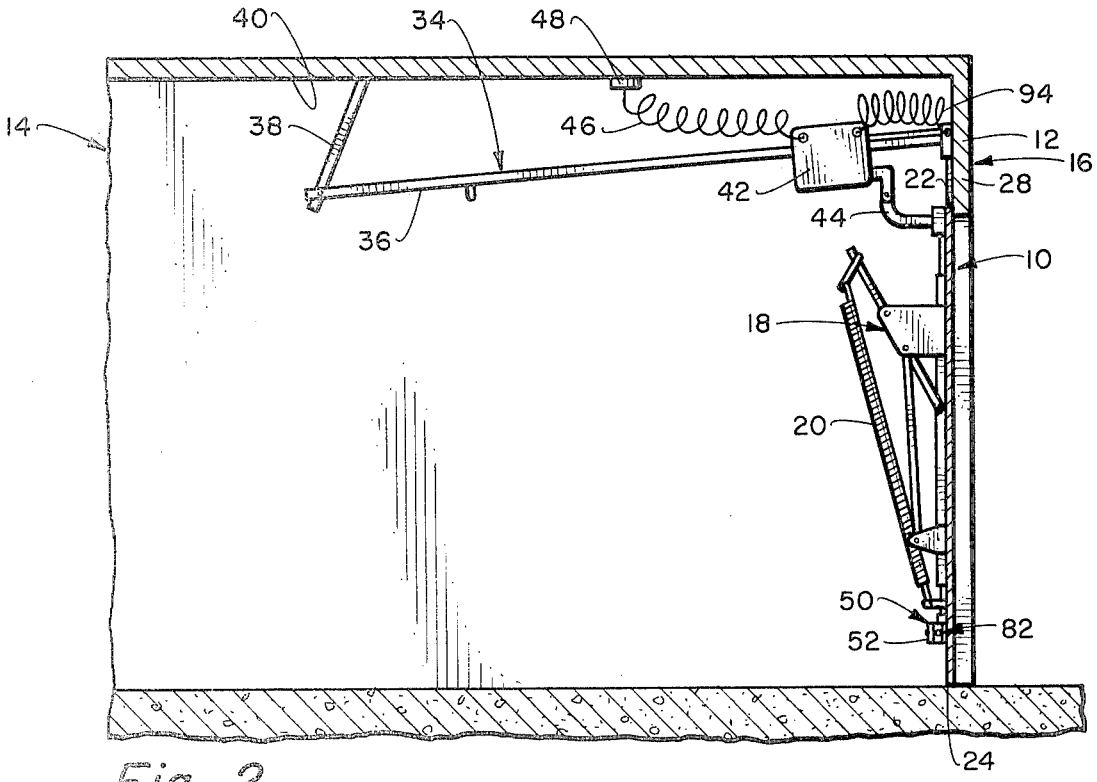
FIG. 2 is a fragmentary vertical sectional view looking in the direction of the arrows 2—2 in FIG. 1.
Figure 3:
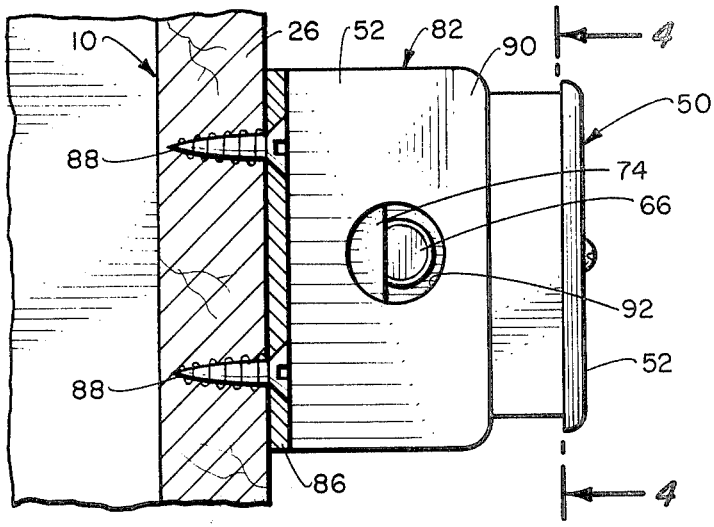
FIG. 3 is an enlarged, fragmentary vertical sectional view looking in the direction of the arrows 3—3 in FIG. 1.

As hereinbefore broadly alluded to, one of the electrically actuated solenoid assemblies 50 is preferably mounted at each side of the garage door 10 actionable between each of the door frame side edges 30 and each of the garage door side edges 26 near the garage door lower edge 24 as best seen in FIGS. 1 and 2. Specifically, in each case, an electrically actuated solenoid assembly 50 is interiorly secured to the particular door frame side edge 30 with the housing 52 secured to the door frame side edge 30 by the fasteners 80 and the forward end of the housing specifically spanning the particular clearance opening 32 between the garage door and frame side edges 26 and 30 and appreciably overlapping the garage door side edge 26 a determined distance, although not secured thereto. In other words, as clearly shown in FIGS. 4 and 5, the mounting of the particular electrically actuated solenoid assembly 50 secured to its particular door frame side edge 26 is such that the housing 52 of the assembly projects across the particular clearance opening 32 and overlies the particular garage door side edge 26 a determined distance with the solenoid plunger 66 reciprocal from that door overlap position between its withdrawn position and its extended position even more greatly overlapping the particular garage door side edge 26. This clearance opening spanning and door side edge overlapping by the housing 52 of each of the solenoid assemblies 50 is of importance to the principles of the present invention as will be hereinafter discussed.

Figure 4:
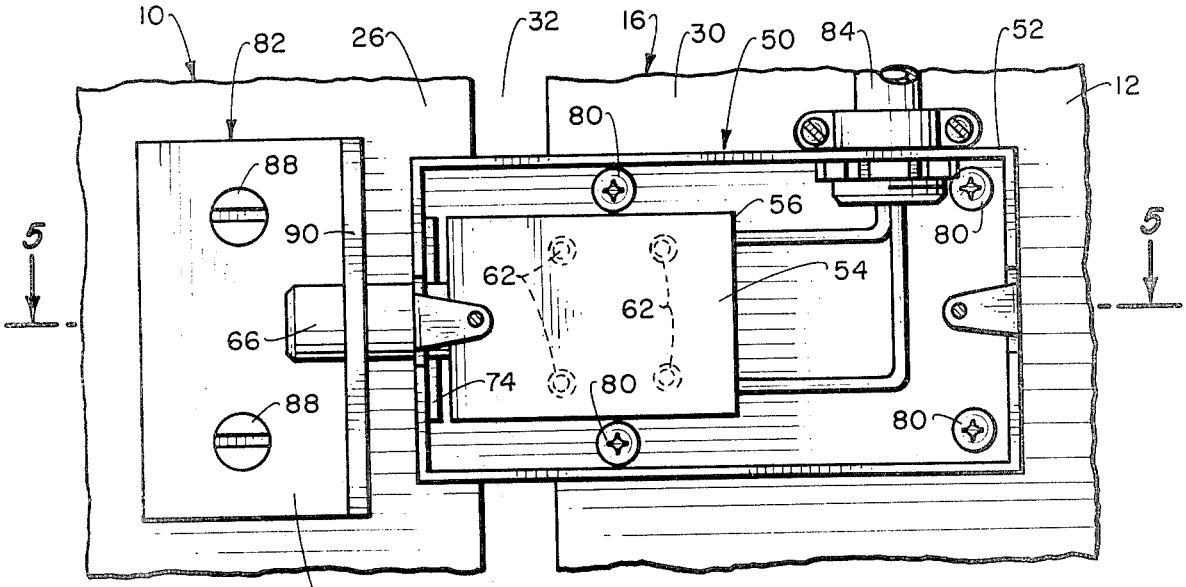
FIG. 4 is a fragmentary vertical sectional view looking in the direction of the arrows 4—4 in FIG. 3.
Figure 5:
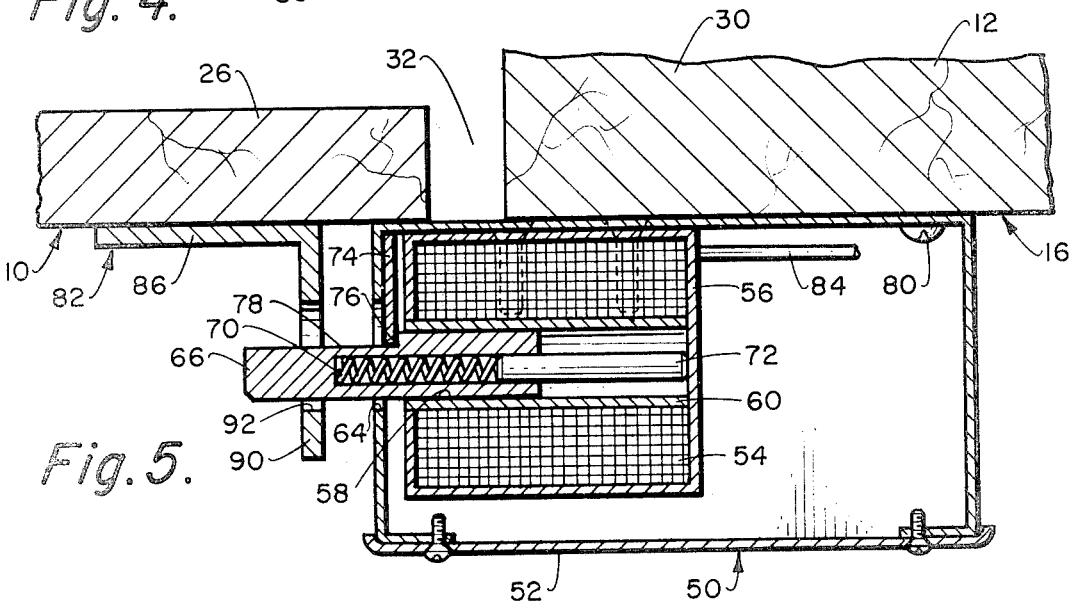
FIG. 5 is a fragmentary horizontal sectional view looking in the direction of the arrows 5—5 in FIG. 4.

The required elements for the functional operation of the electrically actuated solenoid assemblies 50 are completed by a latch member 82 interiorly secured to each of the garage door side edges 26 and an electric power supply line 84 operably connected to each of the electrically actuated solenoid assemblies 50. As shown, each of the latch members 82 is generally L-shaped in configuration having a mounting leg 86 secured to the garage door 10 by fasteners 88 and a plunger engagement leg 90 spaced slightly from the forward overlapping extremity of the particular solenoid assembly housing 52 when the garage door is in closed position. Again, as best seen in FIGS. 4 and 5, each latch member 82 is secured properly aligned for reception of its particular solenoid plunger 66 through an engagement opening 92 thereof when the particular plunger is in its extended position.

One of the electric power supply lines 84 is operably connected to each of the solenoid assembly solenoid coils 54 extending through the housings 52 and upwardly interiorly along the door frame side edges 30 as shown in FIG. 1. These electric power supply lines 84 may be connected through a common switch (not shown) for receiving electric power from the main garage power supply line separate from the garage door opener 42, if desired, requiring separate electrical actuation of the solenoid assemblies 50 and the garage door opener 42 in proper sequence. However, it is preferred to connect the electric power supply lines 84 for the solenoid assemblies 50 directly with the electrical circuits of the garage door opener 42 as shown in FIGS. 1 and 2. The separate electric power supply lines 84 from the solenoid assemblies 50 are directed inwardly above the garage door 10 and joined centrally above the garage door into a common line 94 which extends generally along the guide track 36 of the garage door opener 42 into the electrical circuit of the opener, this common line 94 being sufficiently flexible to permit full forward and rearward movement of the opener along the guide track. Thus, at all times that the garage door opener 42 is actuated by electrical power, the solenoid assemblies 50 will be actuated with electrical power to move the plungers 66 thereof to their withdrawn positions disengaged from and free of the latch members 82.

In overall operation of the electrically actuated overhead garage door opener assembly including the improvements of the present invention, when the garage door 10 is in its closed position as.shown and the garage opener 42 is free of actuation, with the solenoid assemblies 50 directly electrically connected into the opener electric circuit, the solenoid assemblies 50 will likewise be in nonelectrically actuated condition. Thus, not only will the garage door opener 42 gripping the guide track 36 be retaining the garage door 10 in this closed position, but for the added security as provided by the improvements of the present invention, the solenoid plungers 66 of the solenoid assemblies 50 will be in their resiliently urged extended positions engaged through the respective latch members 82 so as to securely lock the garage door in this closed position. Furthermore, due to the fact that the housings 52 of the solenoid assemblies 50 project completely across the clearance openings 32 between the garage door and the door frame side edges 26 and 30 and markedly overlap the door side edges, the solenoid plunger 66 will be spaced inwardly from and not accessible through such clearance openings 32 so that unauthorized persons will not have the solenoid plungers accessible to them for attempted manipulation of the same to disengage the latch members 82 which, of course, could destroy the locking effect of the solenoid assemblies 50. Greatly increased security is, therefore, provided for the garage door 10 in its closed position by this unique positioning of the solenoid assemblies 50.

When it is desired to open the garage door 10, it is merely necessary to conventionally actuate the garage opener 42 by the internal electrical switch or by the usual remote control means usually carried in an automobile. Electrical actuation of the garage door opener 42 starts movement thereof along the guide track 36 and instantaneously with such commencement of garage door opener actuation, the solenoid coils 54 of the solenoid assemblies 50 are electrically actuated withdrawing the solenoid plungers 66 from the latch members 82 so as to release the garage door 10 for its opening movement. The solenoid assemblies 50 will remain electrically actuated throughout the garage door opener 42 moving along the guide track 36 in this door opening movement, but this is of absolutely no consequence to the normal garage door opening. Eventually, the garage door 10 will have been moved progressively upwardly and generally horizontally into the interior of the garage 14 finally into fully open position where the electric power to the opener will be automatically disrupted in usual manner, thereby also de-energizing the solenoid assemblies 50 permitting the solenoid plungers 66 thereof to be resiliently urged outwardly again to extended position where they will remain until the garage door opener is again actuated for door closing.

For again closing the garage door 10, it is merely electrically actuated in the conventional manner which, through the conventional electric controls, actuates the garage door opener 42 in the opposite direction. As in the opening movement, electrical actuation of the garage door opener 42 instantaneously electrically actuates the solenoid assemblies 50 causing the solenoid plungers 66 to move inwardly to their withdrawn positions where they remain throughout the reverse closing movement of the garage door 10. Finally, the garage door 10 again reaches its fully closed position and the electrical power to the garage door opener 42 is again terminated thereby likewise terminating the electrical power to the solenoid assemblies 50. This permits the solenoid plungers 66 to be released from their withdrawn positions and resiliently urged to their projecting extended positions and since the plungers are now aligned with the garage door latch members 82, the solenoid plungers once again engage the latch members to retain the garage door locked in its closed position.

It is pointed out that in the preferred embodiment hereinbefore described the improvements of the present invention have been applied to a garage door of the solid or single-piece assembly type which pivots as a unit between its closed and opened positions and in such case, the solenoid assemblies 50 are preferably mounted near the lower extremities of the garage door 10 and door frame 16. Particularly, with this type of door, these solenoid assemblies 50 must be mounted spaced downwardly from the axis of pivotal movement of the door so that they will not interfere with garage door movement between its closed and opened positions. Note that the lower portion of the garage door 10 pivots away from the solenoid assemblies 50 in movement from closed toward opened position and reversely pivots back to the solenoid assemblies in movement from opened toward closed position so that there is no interference therebetween despite the fact that the housings 52 of the solenoid assemblies project entirely across the clearance openings 32 between the door 10 and door frame 16 and markedly overlap the door 10 when in its closed position. In applying the principles of the present invention to overhead garage doors of different form and different paths of movement, these interference considerations may be of lesser or even more consequence depending on the particular movement patterns.

According to the improvements of the present invention, therefore, an electrically actuated overhead garage door opener assembly is provided having the conventionally functional garage door opener assembly 34 operable for automatically opening and closing the garage door 10 in the usual manner, but added thereto are the unique electrically actuated solenoid assemblies 50 perfectly coordinated therewith for securely locking the garage door in its closed position. Furthermore, due to the unique overlapping mounting of these supplemental solenoid assemblies 50 as hereinbefore described, the additional locking of the garage door 10 in its closed position is made more secure and less subject to unauthorized attack. Still further, due to the unique and more simplified construction of the solenoid assemblies 50 including both the unique solenoid plunger guiding and actuation, and the unique stop plate solenoid plunger control, the improvements of the present invention may be provided for a minimum additional cost while insuring more positive operation of the solenoid assemblies. Finally, with the additional security for the garage door 10 positively locking the same in closed position, unauthorized attempts at opening the garage door or flexing or breaking the same to gain access are markedly frustrated.

I claim:

1. In an electrically actuated overhead garage door opener assembly of the type selectively actionable for moving a garage door between a generally vertical closed position received in a door frame and a generally vertically and rearwardly raised open position providing an access opening through said door frame, there being clearance openings between sides of said door and sides of said door frame when said door is in said closed position; the improvements comprising: an electrically actuated solenoid secured interiorly on a side of said door frame and having housing means projecting transversely from said door frame side across said clearance opening and transversely interiorly overlapping and adjacent of said door sides when said door is in said closed position, said solenoid housing means being positioned on said door frame side free of interference with said door during said door movement between said open and closed positions, a solenoid plunger normally resiliently urged to extended position projecting transversely from said solenoid housing means when said solenoid is not electrically actuated and movable to a withdrawn position relative to said housing means when said solenoid is electrically actuated; a latch member interiorly secured to said door transversely aligned and transversely receiving said solenoid plunger therein when said door is in said closed position and said solenoid plunger is in said extended position preventing movement of said door from said closed position, electrical actuation of said solenoid moving said solenoid plunger to withdrawn position free of latch member reception permitting door movement from and into said door closed position; electric power supply means operably connected to said solenoid for electrically actuating said solenoid during door movement from and into said door closed position; whereby, said solenoid plunger locks said door in door closed position when said solenoid is not electrically actuated while said solenoid case guards said clearance opening between sides of said door and frame and positions said solenoid plunger transversely displaced from said clearance opening less subject to unauthorized manipulation.

2. In an electrically actuated overhead garage door opener assembly as defined in claim 1 in which said electric power supply means is operably connected into an electric power supply means of said garage door opener receiving electric power therefrom and electrically actuating said solenoid throughout electrical actuation of said garage door opener.

3. In an electrically actuated overhead garage door opener assembly as deined in claim 1 in which said solenoid with solenoid plunger and its latch member are a first solenoid and latch member secured at one of said door frame and door sides and a second similar solenoid and latch member are secured at opposite door frame and door sides; and in which said electric power supply means is operably connected to both said first and second solenoids for simultaneously electrically actuating said first and second solenoids during door movement from and into said door closed position.

4. In an electrically actuated overhead garage door opener assembly as defined in claim 1 in which said solenoid with solenoid plunger and its latch member are a first solenoid and latch member secured at one of said door frame and door sides and a second similar solenoid and latch member are secured at opposite door frame and door sides; and in which said electric power supply means is operably connected to both said first and second solenoids, said electric power supply means being operably connected into an electric power supply means of said garage door opener receiving electric power therefrom and electrically actuating both of said first and second solenoids throughout electrical actuation of said garage door opener.

5. In an electrically actuated overhead garage door opener assembly as defined in claim 1 in which said electric power supply means includes coupling means operably associated with an electric power supply means of said garage door opener for supplying electrical power to and electrically actuating said solenoid throughout said electrical power supply means of said garage door opener supplying electrical power to and electrically actuating said garage door opener.

6. In an electrically actuated overhead garage door opener assembly as defined in claim 1 in which said solenoid with solenoid plunger and its latch member are a first solenoid and latch member secured at one of said door frame and door sides and a second similar solenoid and latch member are secured at opposite door frame and door sides; and in which said electrical power supply means is operably connected to both said first and second solenoids, said electric power supply means including coupling means operably associated with both said electric power supply means of said first and second solenoids and an electric power supply means of said garage door opener for supplying electric power and electrically actuating both said first and second solenoids throughout the supplying of electrical power to and electrically actuating said garage door opener.

7. In an electrically actuated overhead garage door opener assembly as defined in claim 1 in which said solenoid is of the type having a tubular coil axially slidably receiving said plunger therein resiliently urged axially forwardly to said extended position projecting at least a determined distance from the coil when the coil is not electrically actuated and moved axially rearwardly into a lesser extended withdrawn position when the coil is electrically actuated, said solenoid coil being electrically actuated when said solenoid is electrically actuated by said electric power supply means; and in which said solenoid includes an axial recess in said plunger terminating forwardly axially intermediate said plunger and opening rearwardly through a plunger rearward end, resilient compression means in said plunger recess, an axially extending guide member having a forward end forwardly received in said plunger recess forwardly abutting said resilient compression means, positioning means operably connected to said guide member confining said guide member against rearward movement relative to said coil to normally retain said guide member compressing said resilient compression means to normally resiliently urge said plunger forwardly and position said guide member aiding and guiding said plunger in its forward and rearward movement.

8. In an electrically actuated overhead garage door opener assembly as defined in claim 1 in which said solenoid is of the type having a tubular coil axially slidably receiving said plunger therein resiliently urged axially forwardly to said extended position projecting at least a determined distance from the coil when the coil is not electrically actuated and moved axially rearwardly into a lesser extended withdrawn position when the coil is electrically actuated, said solenoid coil being electrically actuated when said solenoid is electrically actuated by said electric power supply means; in which said solenoid includes an axial recess in said plunger terminating forwardly axially intermediate said plunger and opening rearwardly through a plunger rearward end, resilient compression means in said plunger recess, an axially extending guide member having a forward end forwardly received in said plunger recess forwardly abutting said resilient compression means, positioning means operably connected to said guide member confining said guide member against rearward movement relative to said coil to normally retain said guide member compressing said resilient compression means to normally resiliently urge said plunger forwardly and position said guide member aiding and guiding said plunger in its forward and rearward movement; in which said solenoid with solenoid plunger and its latch member are a first solenoid and latch member secured at one of said door frame and door sides and a second similar solenoid and latch member are secured at opposite door frame and door sides; and in which said electric power supply means is operably connected to both said first and second solenoids for simultaneously electrically actuating said first and second solenoids during door movement from and into said door closed position.

9. In an electrically actuated overhead garage door opener assembly as defined in claim 1 in which said solenoid is of the type having a tubular coil axially slidably receiving said plunger therein resiliently urged axially forwardly to said extended position projecting at least a determined distance from the coil when the coil is not electrically actuated and moved axially rearwardly into a lesser extended withdrawn position when the coil is electrically actuated, said solenoid coil being electrically actuated when said solenoid is electrically actuated by said electric power supply means; in which said solenoid includes an axial recess in said plunger terminating forwardly axially intermediate said plunger and opening rearwardly through a plunger rearward end, resilient compression means in said plunger recess, an axially extending guide member having a forward end forwardly received in said plunger recess forwardly abutting said resilient compression means, positioning means operably connected to said guide member confining said guide member against rearward movement relative to said coil to normally retain said guide member compressing said resilient compression means to normally resiliently urge said plunger forwardly and position said guide member aiding and guiding said plunger in its forward and rearward movement; in which said solenoid with solenoid plunger and its latch member are a first solenoid and latch member secured at one of said door frame and door sides and a second similar solenoid and latch member are secured at opposite door frame and door sides; and in which said electric power supply means is operably connected to both said first and second solenoids, said electric power supply means being operably connected into an electric power supply means of said garage door opener receiving electrical power therefrom and electrically actuating both said solenoids simultaneously throughout electrical actuation of said garage door opener.

10. In an electrically actuated overhead garage door opener assembly as defined in claim 1 in which said solenoid is of the type having a tubular coil axially slidably receiving said plunger therein resiliently urged axially forwardly to said extended position projecting at least a determined distance from the coil when the coil is not electrically actuated and moved axially rearwardly into a lesser extended withdrawn position when the coil is electrically actuated, said coil being electrically actuated when said electric power supply means electrically actuates said solenoid; and in which said solenoid includes a transverse shoulder on said plunger axially intermediate said plunger, a main case forming at least a part of said solenoid housing means having said coil secured therein and having a forward wall spaced forwardly of said coil with plunger opening means therethrough normally permitting free axial movement of said plunger therethrough and from said coil, a separate generally transverse stop plate means slidably received between said coil and said main case forward wall positioned in forward axial interference with said plunger shoulder while permitting forward resiliently urged movement of said plunger to engagement between said plate means and plunger shoulder so as to limit forward movement of said plunger relative to said coil and main case.

11. In an electrically actuated overhead garage door opener assembly as defined in claim 1 in which said solenoid is of the type having a tubular coil axially slidably receiving said plunger therein resiliently urged axially forwardly to said extended position projecting at least a determined distance from the coil when the coil is not electrically actuated and moved axially rearwardly into a lesser extended withdrawn position when the coil is electrically actuated, said coil being electrically actuated when said electric power supply means electrically actuates said solenoid; and in which said solenoid includes a transverse shoulder on said plunger axially intermediate said plunger, a main case forming at least a part of said solenoid housing means having said coil secured therein and having a forward wall spaced forwardly of said coil with plunger opening means therethrough normally permitting free axial movement of said plunger therethrough and from said coil, a separate generally transverse stop plate means slidably received between said coil and said main case forward wall positioned in forward axial interference with said plunger shoulder while permitting forward resiliently urged movement of said plunger to engagement between said plate means and plunger shoulder so as to limit forward movement of said plunger relative to said coil and main case, an axial recess in said plunger terminating forwardly axially intermediate said plunger and opening rearwardly through a plunger rearward end, resilient compression means in said plunger recess, an axially extending guide member having a forward end forwardly received in said plunger recess forwardly abutting said resilient compression means, positioning means operably connected to said guide member confining said guide member against rearward movement relative to said coil to normally retain said guide member compressing said resilient compression means to normally resiliently urge said plunger forwardly and position said guide member aiding in guiding said plunger in its forward and rearward movement.

12. In an electric solenoid construction of the type having a tubular coil axially slidably receiving a plunger therein resiliently urged axially forwardly to an extended position projecting at least a determined distance from the coil when the coil is not electrically actuated and moved axially rearwardly into a lesser extended withdrawn position when the coil is electrically actuated; the improvements comprising: an axial recess in said plunger terminating forwardly axially intermediate said plunger and opening rearwardly through a plunger rearward end, resilient compression means in said plunger recess, an axially extending guide member having a forward end forwardly received in said plunger recess forwardly abutting said resilient compression means, positioning means operably connected to said guide member confining said guide member against rearward movement relative to said coil to normally retain said guide member compressing said resilient compression means to normally resiliently urge said plunger forwardly and position said guide member aiding in guiding said plunger in its forward and rearward movement.

13. In an electric solenoid construction as defined in claim 12 in which said resilient compression means includes a compression spring in said plunger recess; and in which said axially extending guide member includes a rod having its forward end forwardly received in said plunger recess forwardly abutting said compression spring.

14. In an electric solenoid construction as defined in claim 12 in which said positioning means is a rigid rear case wall of said solenoid.

15. In an electric solenoid construction as defined in claim 12 in which said guide member is operably connected to said positioning means merely rearwardly abutting said positioning means.

16. In an electric solenoid construction as defined in claim 12 in which said positioning means includes a rear case wall of said solenoid operably connected to said guide member; and in which said guide member merely rearwardly abuts said solenoid rear case wall.

17. In an electric solenoid construction as defined in claim 12 in which said positioning means includes a rear case wall of said solenoid; in which said guide member includes a rod having its forward end forwardly received in said plunger recess forwardly abutting said resilient compression means and merely rearwardly abutting said solenoid rear case wall; and in which said resilient compression means includes a compression spring in said plunger recess forwardly of said rod forwardly abutted by said rod.

18. In an electric solenoid construction as defined in claim 12 in which said electric solenoid construction further includes a transverse shoulder on said plunger axially intermediate said plunger, a main case having said coil secured therein and having a forward wall spaced forwardly of said coil with plunger opening means therethrough normally permitting free axial movement of said plunger therethrough and from said coil, a separate generally transverse stop plate means slidably received between said coil and said main case forward wall positioned in forward axial interference with said plunger shoulder while permitting forward resiliently urged movement of said plunger to engagement between said plate means and plunger shouler so as to limit forward movement of said plunger relative to said coil and main case.

19. In an electric solenoid construction of the type having a tubular coil axially slidably receiving a plunger therein resiliently urged axially forwardly to an extended position projecting at least a determined distance from the coil when the coil is not electrically actuated and moved axially rearwardly into a lesser extended withdrawn position when the coil is electrically actuated; the improvements comprising: a transverse shoulder on said plunger axially intermediate said plunger, a main case having said coil secured therein and having a forward wall spaced forwardly of said coil with plunger opening means therethrough normally permitting free axial movement of said plunger therethrough and from said coil, a separate generally transverse stop plate means slidably received between said coil and said main case forward wall positioned in forward axial interference with said plunger shoulder while permitting forward resiliently urged movement of said plunger to engagement between said plate means and plunger shoulder so as to limit forward movement of said plunger relative to said coil and main case.

20. In an electric solenoid construction as defined in claim 19 in which said transverse shoulder on said plunger is formed by a cut-out of said plunger extending from said shoulder to a forward end of said plunger.

21. In an electric solenoid construction as defined in claim 19 in which said stop plate means includes a stop plate slidably received between said coil and said main case forward wall and adhesively secured therebetween.

22. In an electric solenoid construction as defined in claim 19 in which said transverse shoulder on said plunger is formed by a cut-out of said plunger extending from said shoulder to a forward end of said plunger; and in which said stop plate means includes a stop plate slidably received between said coil and said main case forward wall and adhesively secured therebetween.

* * * * *